US006195002B1

(12) United States Patent
Evans, Jr. et al.

(10) Patent No.: US 6,195,002 B1
(45) **Date of Patent: *Feb. 27, 2001**

(54) ALARMS FOR MONITORING OPERATION OF SENSORS IN A FIRE-SUPPRESSION SYSTEM

(75) Inventors: Richard P. Evans, Jr., 444 Maria Ave., Monmouth, OR (US) 97361; Steven R. Wheeler, Toledo, OR (US)

(73) Assignee: Richard P. Evans, Jr., Monmouth, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/245,094

(22) Filed: Jan. 22, 1999

(51) Int. Cl.[7] ..... G08B 29/00; E03B 7/07

(52) U.S. Cl. ..... 340/506; 340/691.1; 340/693.5; 340/603; 340/618; 169/5; 169/23; 137/551; 137/557

(58) Field of Search ..... 340/506, 691, 340/693.5, 693.9, 603, 606, 618, 525, 588, 589, 514; 169/56, 5, 23, 60; 137/551, 557, 561 R, 556.6, 312, 78.3, 624.11; 116/227, 112; 73/49.5; 700/282, 283, 284; 251/129.01

(56) References Cited

U.S. PATENT DOCUMENTS

| | | | |
|---|---|---|---|
| 4,406,398 | 9/1983 | Perkins | 137/551 |
| 5,139,044 | 8/1992 | Otten et al. | 137/80 |
| 5,240,022 | 8/1993 | Franklin | 137/312 |
| 5,638,847 | 6/1997 | Hoch, Jr. et al. | 137/80 |
| 5,655,561 | 8/1997 | Wendel et al. | 137/79 |
| 5,864,287 | 1/1999 | Evans, Jr. et al. | 340/506 |

*Primary Examiner*—Donnie L. Crosland
(74) *Attorney, Agent, or Firm*—Klarquist Sparkman Campbell Leigh & Whinston, LLP

(57) ABSTRACT

Alarms for testing sensors, particularly those used in fire-suppression systems, are described. In one aspect of the invention, the alarm includes an audio and/or a visual indicator operably coupled to the housing of a sensor. The audio indicator may be a speaker that beeps when the sensor is activated. The visual indicator may be one or more LEDs that are illuminated when the sensor is activated. The alarm also can be used to determine whether power and ground conductors extending to the sensor are properly connected. Additionally the alarm can be used to determine whether one or more conductors extending from the sensor to the control panel are properly connected. Certain applications of the invention are intended primarily for use with existing fire-suppression-systems. The invention also can be employed in new fire-suppression system installations using a dry-contact circuit embodiment of the invention (FIG. 5). The dry-contact circuit allows the present invention to be used with conventional pressure and flow sensors, and conventional alarm-monitoring circuitry.

6 Claims, 5 Drawing Sheets

10
Main Conduit
12
14
Branch Conduits
16
To Sprinkler Heads
Pressure Sensor (For dry systems)
30
50
Alarm built into sensor
36
Flow Sensor (For wet systems)
32
52
38
Control Panel
40
42
44
54
Tamper Sensor
34
Modem
46
Valve
20
18
Call to Monitoring Service

ALARMS FOR MONITORING OPERATION OF SENSORS IN A FIRE-SUPPRESSION SYSTEM

CROSS REFERENCE TO RELATED APPLICATION

This application claims priority from patent application No. 08/786,884, filed on Jan. 23, 1997, U.S. Pat. No. 5,864,287, which is incorporated herein by reference.

FIELD OF THE INVENTION

This invention concerns alarms operably coupled to sensors (e.g., flow, pressure, and tamper sensors) for monitoring sensor operation and, more particularly, to alarms mounted to or within sensors generally used in fire-suppression systems.

BACKGROUND OF THE INVENTION

Fire-suppression systems are installed in virtually all new buildings to help protect property and persons occupying such buildings in the case of fire. Fire-suppression systems have an array of fire sprinklers strategically located throughout a building. Water flows from a main conduit and through branch conduits and sprinkler heads when the fire-suppression system operates. Sprinkler heads often include a "plug" made from a material having a relatively low melting point that prevents water from flowing through the sprinkler heads when the fire-suppression system is not in operation. The low-melting point material melts when exposed to high temperatures, thereby allowing water to flow onto the fire through the sprinkler heads.

There are several types of fire-suppression systems, including both "wet" and "dry" systems. A "wet" system has water in the main and branch conduits. A "dry" system, on the other hand, has pressurized air in the branch conduits leading to the sprinkler heads. The pressurized air forces a clapper mounted in the main conduit to remain in a closed position, thereby preventing water from flowing into the branch conduits. The pressurized air is released when the sprinkler heads open in response to fire. This causes the clapper to open, and water then flows out of the sprinkler heads.

Fire-suppression systems typically include at least one shut-off valve coupled to the main conduit for interrupting the flow of water to the building when repair work or safety inspections are required. The shut-off valve may be located on the inside or outside of the building. Common outdoor valves include wall-post-indicator valves (WPIV) and post-indicator valves (PIV). WPIVs are mounted to outside walls of buildings and include control wheels that are rotated to open and close the valve. PIVs are located away from the building, typically near an adjacent street, and look similar to fire hydrants. PIVs usually have a rotatable nut that is rotated to open and close the valve. Other types of valves, such as outside stem-and-yoke valves (OS&Y) and butterfly valves, also commonly are used with fire-suppression systems.

Fire-suppression systems also generally include control panels that receive signals from various sensors located throughout the building. Flow, pressure and tamper sensors are examples of sensors coupled to fire-suppression systems. The sensors indicate whether an alarm condition exists as a result of fire, or that maintenance is required. Flow sensors are mounted to main or branch conduits to signal the control panel when water is flowing through the system. Low and/or high pressure sensors are coupled to main air-or water-carrying conduits to detect if the fluid pressure within such conduits drops below or rises above an acceptable, predetermined level. This most likely occurs as a result of a fire or loss of electrical power to the air compressor. Tamper sensors are mounted on shut-off valves (e.g., WPIVs, PIVs and OS&Ys) to signal the control panel if the valve is turned off during a maintenance inspection or by unauthorized persons tampering with the valves.

When a sensor is activated, a signal from the sensor activates an alarm on the control panel. The control panel contacts a monitoring service by modem. The monitoring service can then determine what caused the alarm and take the appropriate corrective action. For example, the monitoring service may contact the local fire department, maintenance personnel for the fire-suppression system or maintenance personnel for the building.

Maintenance personnel also periodically test fire-suppression systems, including the sensors, to ensure that the system and sensors are operating properly. For example, a drain valve can be opened to run water through a conduit to which a flow sensor is coupled to activate the sensor.

A primary problem encountered by maintenance personnel is that there is no way to determine if a sensor is working properly simply by observing the sensor. Instead, the person testing the system must walk to the control panel to check whether an alarm is activated on the panel in response to activation of the sensor being observed. The control panel almost certainly is located at a remote location, and may be hundreds of yards away from the sensor being observed. With reference to flow sensors, the maintenance person (1) walks back to the drain valve and shuts it off, thereby deactivating the flow sensor, and (2) then returns to the control panel to ensure that the control panel alarm deactivated upon deactivation of the sensor. Each sensor, including all flow, pressure and tamper sensors, is similarly tested.

As a result, testing fire-suppression systems is a laborious, time-consuming task that requires walking back and forth several times from each sensor to the control panel to ensure proper sensor operation. It often is faster to have maintenance personnel work in tandem with one person activating the sensor while a second person monitors the control panel to check that it operates properly. However, employing an extra person increases the cost of testing fire-suppression systems.

The Notifier Company (Notifier) has designed a device to make testing fire-suppression systems more efficient. The NOTIFIER devices have a light-emitting diode (LED) coupled to a sensor through a coaxial cable. The LED is positioned in a metal or plastic box mounted to a wall near the sensor. The LED blinks when the sensor is inactive and is steady when the sensor is active. The NOTIFIER device still requires that maintenance personnel walk to the control panel when the sensor is coupled to a WPIV or PIV positioned outside of the building. Moreover, Notifier's wall-mounted units, coaxial coupling cables and cable conduits are expensive, especially because one conduit and box are used per sensor and large buildings have many sensors. Notifier's wall-mounted LEDs also apparently are not water-resistant, which prevents using them outdoors on WPIVs or PIVs.

It should be apparent from the foregoing that alarms for testing and monitoring sensor operation, particularly sensors used for fire-suppression systems, are still required by the industry.

SUMMARY OF THE INVENTION

The present invention provides alarms for testing and monitoring most, if not all, sensors used in fire-suppression systems. The alarms can be mounted to or within the sensor to conserve space, and include readily available, low-cost parts that can be retrofitted to existing sensors. Alarms made in accordance with the present invention also eliminate the need to check control panel alarms after each sensor is inspected to verify correct sensor operation.

In one aspect of the invention, the alarm includes audio and/or visual indicators extending through or mounted to or within the housing of the sensor. The audio indicator may be a speaker that beeps when the sensor is activated. The visual indicator may be an LED, or perhaps plural LEDs each of a different color, that illuminates when the sensor is activated.

In another aspect of the invention, the alarm detects whether power and ground conductors extending to the sensor are properly operating. Additionally, the alarm detects whether a conductor extending from the sensor to the control panel is properly connected.

A particular embodiment of an alarm made in accordance with the present invention is adapted for use with fire suppression systems having plural sensors either (1) directly mounted to the fluid-carrying conduit or (2) having sensor housings that are mounted to the fluid-carrying conduit. Most such sensors have sensor elements positioned within the fluid-carrying conduit. Alarms in accordance with the invention include switches electrically coupled to the sensor elements for switching from a first state, indicating normal operation of the fire-suppression system, to a second state. The second state indicates either an emergency situation exists, such as a fire, or that maintenance is somehow required, these situations being referred to herein as "alarm conditions". The switches typically have a common terminal, a normally-open terminal and a normally-closed terminal for electrically coupling the common terminal and the normally-closed terminal with the switch in the first state and for electrically coupling the common terminal and the normally-open terminal with the sensor element in the second state.

Most fire-suppression systems include a control panel for monitoring sensors coupled to the system. The control panel has a positive voltage supply terminal, a neutral terminal, and an alarm terminal. The positive voltage supply terminal is electrically coupled to the common terminals on the switches. A first indicator, such as a light-emitting diode, extends through or is otherwise mounted to or within each sensor housing in a manner allowing detection by maintenance personnel of the signal, either visual or auditory, that is emitted by the alarm. The first indicator has one end electrically coupled to the normally-open terminal on each switch and an opposed end electrically coupled to the alarm terminal on the control panel. The first indicator is electrically activated when the switch to which it is coupled is in the first state and is electrically deactivated when the switch to which it is coupled is in the second state. A second indicator also extends through or is operably mounted to or within each sensor housing. The second indicator has one end electrically coupled to the normally-open terminal on the switch and an opposed end electrically coupled to the neutral terminal on the control panel. The second indicator is electrically activated when the switch to which it is coupled is in the second state and is electrically deactivated when the switch to which it is coupled is in the first state.

The fire-suppression system may further comprise a valve coupled to the fluid-carrying conduit for controlling fluid flow to or within the conduit. A valve sensor, generally housed in a valve sensor housing, is operably coupled to the valve for detecting whether the valve is open or closed. A switch, electrically coupled to the valve sensor, switches from a first state, indicating that the valve is either open or closed, to a second state indicating that an open valve has closed or that a closed valve has opened. The control panel also is electrically coupled to the switch. A first indicator extends through or is otherwise operably mounted to or within the valve sensor housing and has one end electrically coupled to the switch and an opposed end electrically coupled to the control panel. The first indicator is electrically activated when the switch is in the first state and is electrically deactivated when the switch is in the second state. A second indicator also extends through or otherwise is operably mounted to or within the valve sensor housing. The second indicator has one end electrically coupled to the switch and an opposed end electrically coupled to the control panel. The second indicator is electrically activated when the switch is in the second state and electrically deactivated when the switch is in the first state.

Alarms made in accordance with the present invention have several advantages. First, the alarms are extremely low-cost, and can be manufactured using only a few standard components. Additionally, certain embodiments of the alarms fit within the housing of a sensor to conserve space. Moreover, the alarms can be used to determine whether power, ground and alarm-signal conductors are properly connected from the control panel to the sensor. Still further, the alarms allow maintenance personnel to readily determine whether a sensor is activated or deactivated, particularly without having to directly observe the control panel to make such determination. Alarms according to the invention also are adaptable to a wide variety of sensors, including tamper, flow, and pressure sensors, and sensors in both wet and dry fire-suppression systems. The alarms also are water-resistant and therefore can be used with sensors that are located outdoors.

These and other advantages of the present invention will become more fully apparent as the description which follows is read in conjunction with the accompanying drawings.

DETAILED DESCRIPTION OF THE PREFERRED EMBODIMENTS

A. Fire-Suppression System Generally

Figure 1:
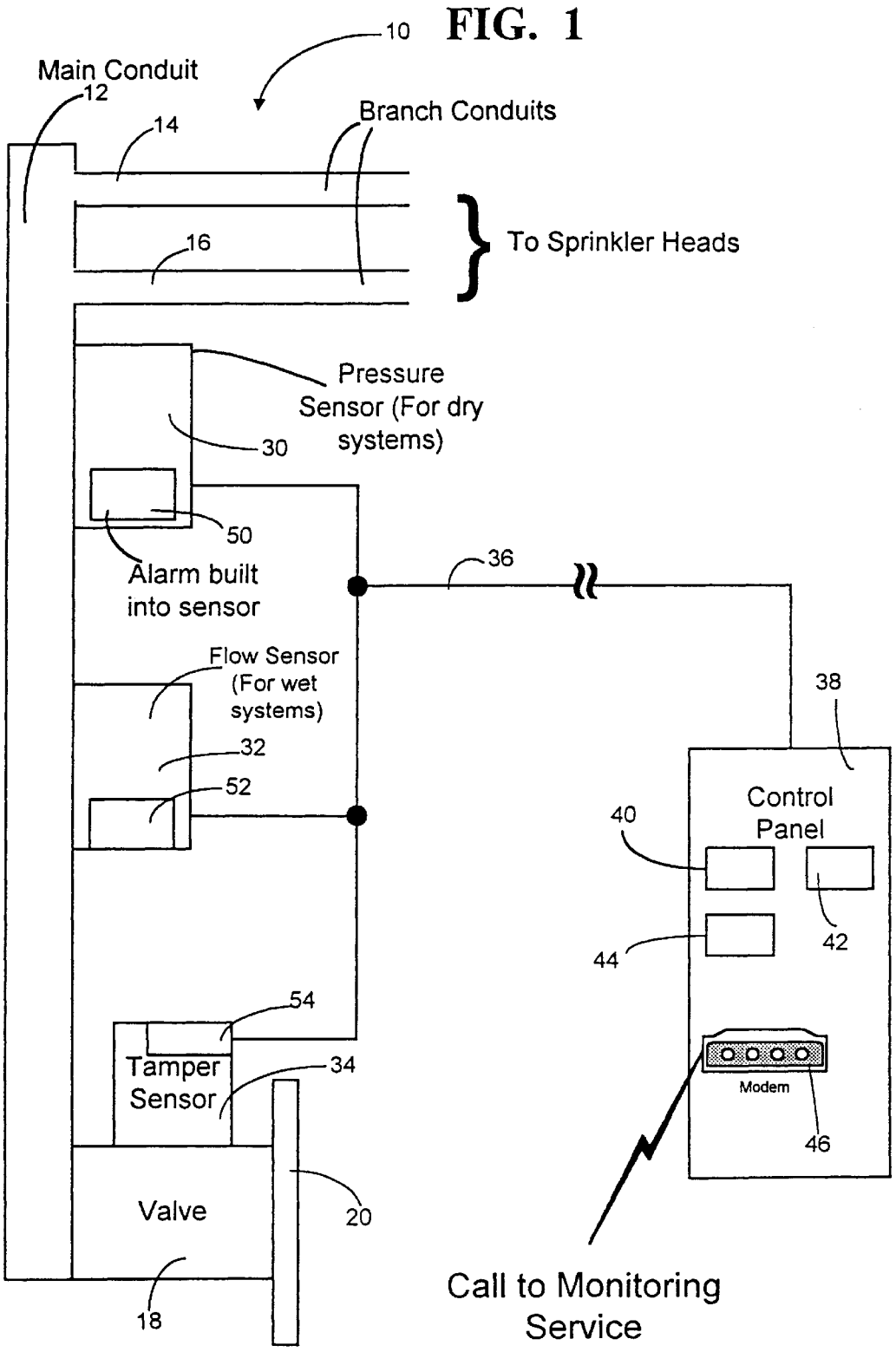
FIG. 1 is a schematic diagram illustrating alarms made in accordance with the present invention operably coupled to sensors, such as pressure, flow and tamper sensors, commonly used to monitor the operation of fire-suppression systems.

FIG. 1 illustrates a fire-suppression system 10 (both wet and dry systems are illustrated) comprising a main fluid-carrying conduit 12 and branch conduits 14 and 16. These conduits supply fire-extinguishing fluid to multiple sprinkler heads (not shown) placed throughout a building or structure. It should be understood that a number of fire-extinguishing fluids can be used with modern fire-suppression systems, including water and carbon dioxide; however, for simplicity the following discussion refers only to water as the fire-extinguishing fluid. In the event of a fire, the sprinkler heads open to spray water, fed from the main conduit 12 and branch conduits 14 and 16, onto the fire.

System 10 also includes a valve 18 for controlling the flow of water to or within the main conduit 12. A shut-off wheel 20 is rotated to open and close the valve 18. Valve 18 can be one of various types, including but not limited to, WPIV, PIV and OS&Y valves. The valve 18 also can be positioned inside or outside of a building.

B. System Sensors and Control Panel

Pressure sensor 30 and flow sensor 32 are operably coupled to main conduit 12. Tamper sensor 34 is operably coupled to valve 18. Pressure sensor 30 and flow sensor 32 monitor fluid pressure and fluid flow through the main conduit 12, respectively. Tamper sensor 34 monitors the operation of valve 18. Thus, sensors 30, 32 and 34 are useful for ensuring that the fire-suppression system 10 operates properly. Sensors similar to sensors 30, 32 and 34 also can be operably coupled to branch conduits 14 and 16 to monitor fluid flow and fluid pressure in the branch conduits, as well as to monitor the function of any valves that may be used to control fluid flow through branch conduits 14 and 16. When activated, sensors 30, 32 and 34 send a signal via bus 36 to a control panel 38 that is located in a location remote from the location of the sensors.

The illustrated control panel 38 includes one or more alarms, such as control-panel alarms 40, 42 and 44. Upon receiving a signal on bus 36, the control panel 38 activates one or more of the control-panel alarms 40, 42 and/or 44. Many types of control panels are currently available. The specific control panel used is not particularly important to the operation of the present invention.

In the illustrated fire-suppression system 10, control panel alarm 40 is activated when a signal is received from sensor 30. Similarly, control panel alarms 42 and 44 are activated upon receiving signals from sensors 32 and 34, respectively. When an alarm is activated, the control panel 38 contacts a monitoring service via modem 46. The monitoring service employs operators to ascertain the cause of the alarm and take corrective action.

Sensor 30 is a pressure sensor for monitoring the air pressure in conduit 12 for a dry system. If the air pressure drops below (low-pressure sensor) or above (high-pressure sensor) a predetermined level, sensor 30 is activated and the control panel 38 is signaled via bus 36. Control-panel alarm 40 is activated to indicate that pressure sensor 30 caused the alarm. The illustrated control panel 40 then automatically contacts the monitoring service. Based on information passed by the modem 46, the monitoring service determines that a fluid-pressure problem exists and takes corrective action.

Sensor 32 is a flow sensor that is operably coupled to the main conduit 12 for monitoring fluid flow therethrough. Flow sensors generally are used for wet systems and would not be mounted adjacent a pressure sensor. Nonetheless, both flow and pressure sensors are shown mounted to the main conduit so that only a single fire-suppression system needs to be shown. Those skilled in the art, therefore, will recognize the illustrated fire-suppression system as either a wet or dry system. When water in the main conduit 12 is static, i.e., not flowing, the flow sensor 32 is not active. Conversely, water flowing through the main conduit 12 activates the flow sensor 32. When flow sensor 32 is activated, an electronic signal is sent to control paper 38 via bus 36 to activate control-panel alarm 42. In the illustrated embodiment of fire-suppression system 10, the monitoring service is then contacted to ascertain the cause of the problem and take corrective action.

Sensor 34 is a tamper sensor that detects movement in wheel 20. Sensor 34 signals the control panel 38 when the wheel 20 is turned beyond a predetermined limit to close a normally open or open a normally closed valve 18. For example, tamper sensor 34 may not be active when the valve 18 is fully opened. If wheel 20 is rotated towards the closed position tamper sensor 34 signals the control panel 38 and activates alarm 44. When the monitoring service determines that the alarm 44 is activated, maintenance or building personnel are sent to the location to ensure that the valve 18 is turned on.

C. Sensor Alarms

FIG. 1 illustrates that sensors 30, 32 and 34 have alarms 50, 52 and 54 mounted inside their respective sensor housings. Alarms 50, 52 and 54 detect whether the sensors 30, 32 and 34, respectively, are activated or not without having to observe control panel 38.

Pressure sensor 30, flow sensor 32 and tamper sensor 34 include similar electrical circuitry and function similarly. For purposes of simplicity, only flow sensor 32 is described below in more detail.

Figure 2:
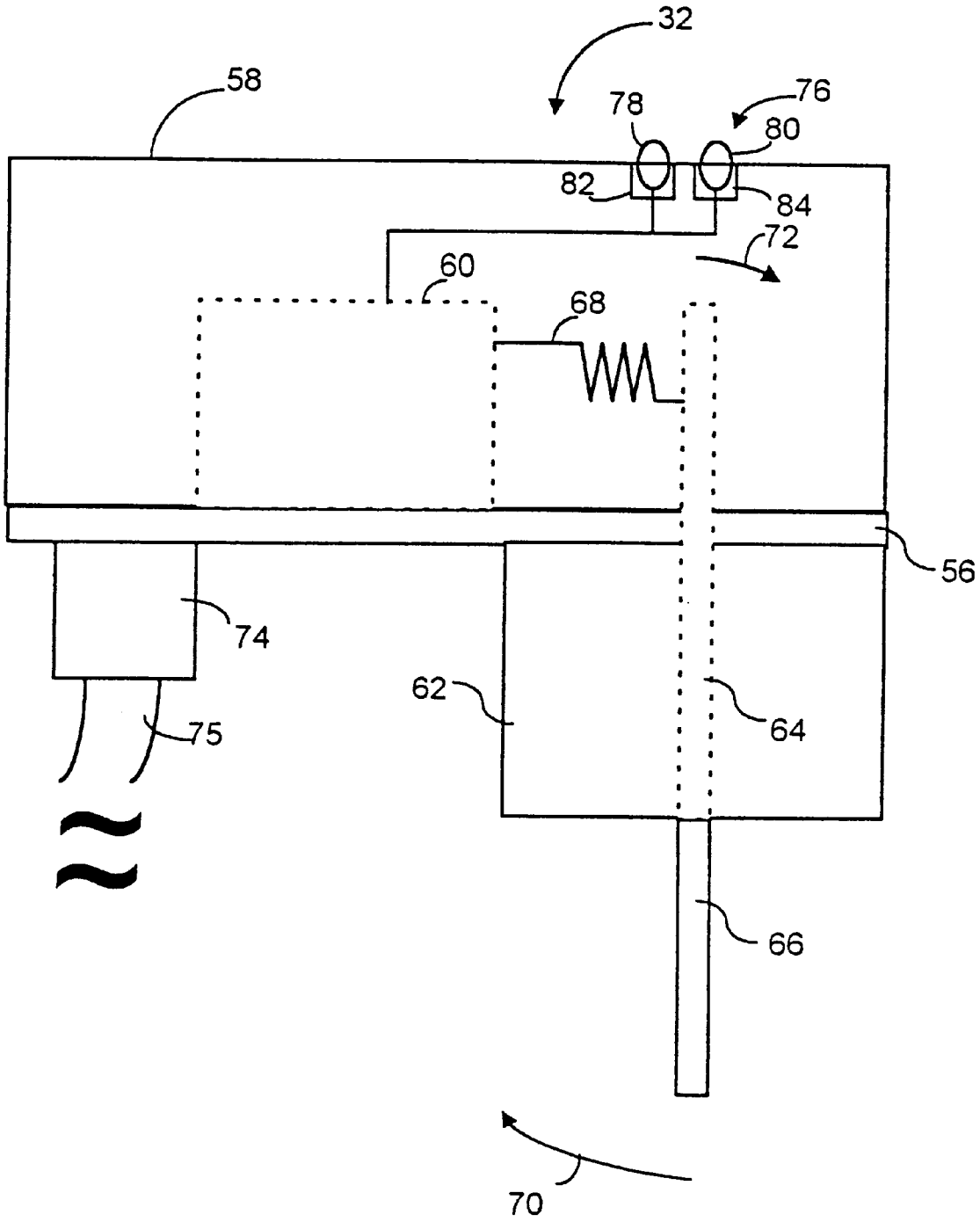
FIG. 2 is a side schematic view of a flow sensor for a wet fire-suppression system wherein the flow sensor has an alarm made in accordance with the present invention coupled thereto.

FIG. 2 is a side schematic view of the flow sensor 32. Sensor 32 includes a mounting plate 56 and an upper housing 58 that defines a cavity within which the components of sensor 32 are housed. Housing 58 is secured to the mounting plate 56 by screws (not shown). An electrical switch 60 also is secured to the mounting plate 56 and is positioned within the cavity.

Sensor 32 also includes a lower housing 62 that is mounted to the mounting plate 56. A rod 64 is pivotally mounted within lower housing 62 and extends through the mounting plate 56 and into the cavity formed by the upper housing 58. A paddle 66 is coupled to the rod 64. Paddle 66 is sized to fit within and is positioned transverse to the direction of fluid flow in main conduit 12.

A first end of tension spring 68 is coupled to electric switch 60. An opposed end of tension spring 68 is coupled to the rod 64. The tension spring 68 urges the paddle 66 into its at-rest position as illustrated in FIG. 2 when fluid is not flowing through main conduit 12. If water flows within the main conduit 12 in a direction from the right side of FIG. 2 to the left side, the paddle 66 moves as indicated by arrow 70, causing the opposed end of rod 64 to move in a direction indicated by arrow 72. The movement of rod 64 exerts a force on the tension spring 68 and activates the switch 60. The switch 60 therefore responds to movement of the paddle 66 and is switched from a deactivated state to an activated state when water flows within the main conduit 12 in the direction stated.

Strain-relief member 74 is mounted to plate 56. Strain-relief member 74 allows electrical conductors 75 (e.g., power lines) to extend into the cavity of the sensor 32.

Alarm 76 is retrofit to existing sensors 32, or may be coupled to the sensor 32 when the sensor 32 is initially constructed. Alarm 76 includes some type of indicator, such as an auditory signal, a visual signal, or both an auditory and a visual signal, to indicate whether the sensor 32 is activated or deactivated. FIG. 2 shows a pair of lights 78, 80 (e.g., LEDs) that act as indicators. Lights 78 and 80 are operably coupled to the sensor 32 as described in more detail below.

FIG. 2 shows that the lights 78 and 80 are secured within apertures 82 and 84, respectively, that extend through the upper housing 58.

Figure 3:
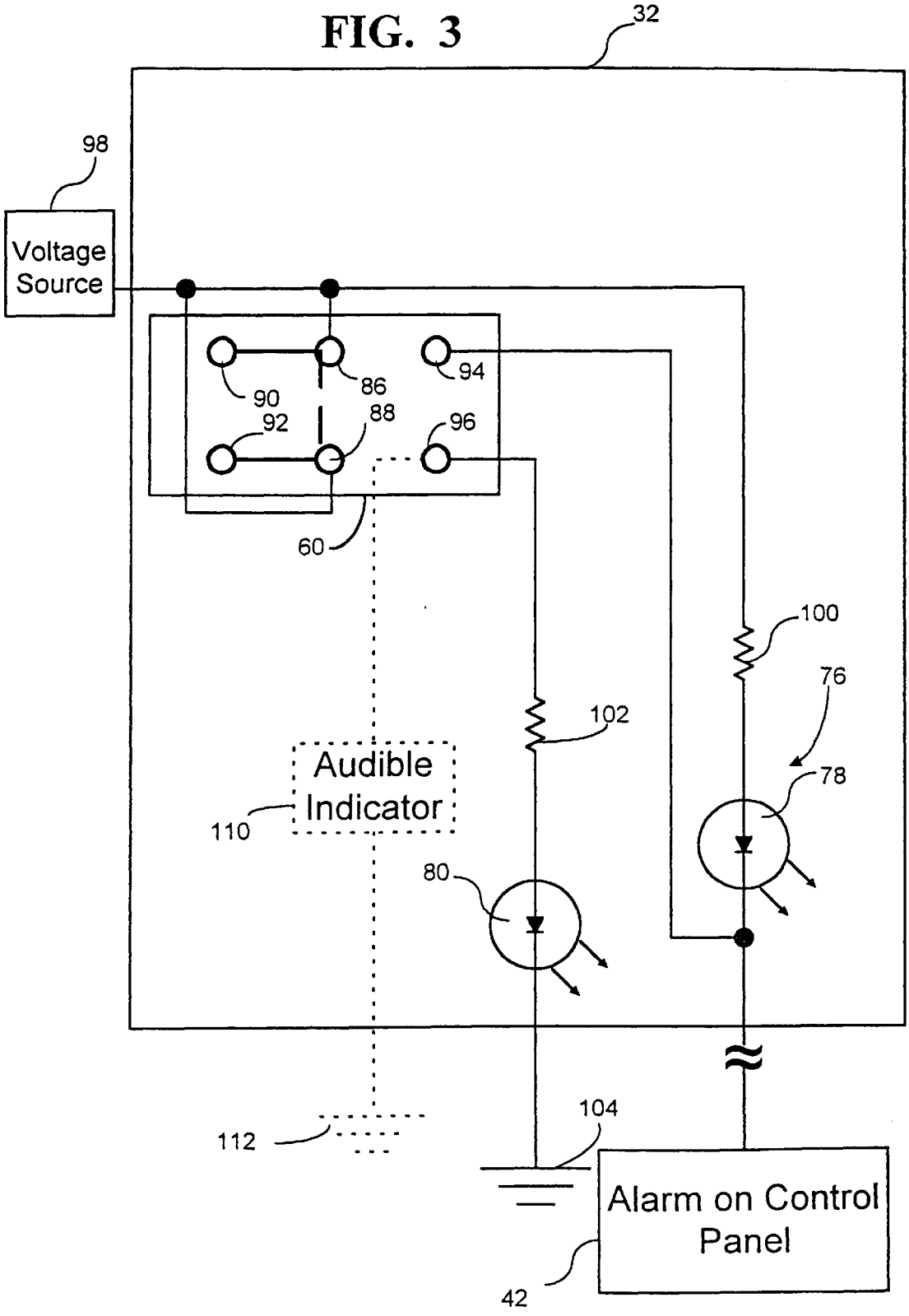
FIG. 3 is a schematic diagram showing electrical circuitry used to control the alarm of FIG. 2.

FIG. 3 shows a detailed schematic diagram of the electronic circuitry within the flow sensor 32. Switch 60 is a double-pole, double-throw electrical switch with two common terminals 86, 88, two normally closed terminals 90, 92 (i.e., the terminals open on alarm) and two normally open terminals 94, 96 (i.e., the terminals close on alarm). When the paddle 66 is in its at-rest position, terminals 86 and 90 are electrically coupled together, and terminals 88 and 92 are electrically coupled together. Conversely, terminals 86 and 94 are electrically uncoupled, and terminals 88 and 96 are electrically uncoupled.

When water flows within main conduit 12, the paddle 66 moves to its alarm position, activating switch 60. As a result, terminals 86 and 94 are electrically coupled and terminals 88 and 96 are electrically coupled. Conversely, terminals 86 and 90 are electrically uncoupled and terminals 88 and 92 are electrically uncoupled.

A voltage source 98 is coupled to the common terminals 86, 88. Alternatively, power can be supplied from the control panel 38 (FIG. 1), or from an alternative power supply (not illustrated). A wide range of voltage sources may be used to power the flow sensor 32, but fire-suppression systems generally use 120 volts AC or 24 volts AC or DC.

The illustrated LED indicators 78 and 80 are coupled to resistors 100 and 102, respectively, that are sealed within a casing (not shown) for protection against water damage. The casing is sized to fit within the upper housing 58. Resistor 100 is coupled at one end to the common terminals 86, 88, and at an opposed end to LED 78. The output of the LED 78 is coupled to both the alarm 42 on control panel 38 and the terminal 94 on switch 60. Resistor 102 is coupled at one end to terminal 96 and at an opposed end to LED 80. The output of LED 80 is tied to ground 104.

When paddle 66 of flow sensor 32 is in its at-rest position, current flows from terminal 86 through resistor 100 to activate LED 78. Although the light output from the LED 78 can be any color, working embodiments of the invention have used an LED 78 which preferably is green when indicating that no alarm condition exists. No current flows from the output of LED 78 to terminal 94 because terminal 94 is electrically floating (i.e., switch 60 is open between terminals 86 and 94). Instead, current flows from the output of LED 78 to alarm 42 on the control panel 38. However, the current is only about 10 milliamps because of current-limiting resistor 100. This current is insufficient to activate the alarm 42 on the control panel. Resistor 100 preferably is an 18 kilohm, one-quarter-watt resistor.

With the paddle 66 in its at-rest position, terminal 96 is floating (i.e., switch 60 is open between terminals 88 and 96). Consequently, no current flows through resistor 102 or LED 80. LED 80 therefore is OFF.

When water flows through the main conduit 12, the paddle 66 moves and activates the switch 60. Thus, terminals 86 and 94 are electrically coupled and terminals 88 and 96 are electrically coupled. The resistor 100 and LED 78 are short-circuited causing LED 78 to be deactivated or turned OFF. Current therefore flows directly from terminal 94 to the alarm 42 on the control panel 38. The alarm 42 is thereby activated because current limiting resistor 100 no longer restricts current flow.

When water flows through main conduit 12, LED 80 also is activated because the coupling of terminals 88 and 96 causes current to flow through resistor 102 and LED 80 to ground 104. Resistor 102 also preferably is an 18 kilohm, one-quarter-watt resistor. Like LED 78, LED 80 can be any color, although in working embodiments of the invention LED 80 has been red. An activated, red LED 80 indicates an alarm condition.

Thus, a maintenance person testing sensors 30, 32 and/or 34 for proper operation can determine whether or not a sensor is activated by viewing or listening to the indicator coupled to the alarm 76. This eliminates the need to walk to the control panel to check the alarms.

Additionally, maintenance personnel can determine whether conductors extending from the control panel 38 to the sensor 32 are properly connected. For example, if the alarm 42 is not connected to LED 78 because of a break in the wire, the LED 78 will shut OFF (when the sensor is deactivated).

Furthermore, the present invention allows any breaks in the power and ground conductors to be detected at the sensor. For example, LED 80 will be turned OFF if the ground conductor is broken. If the power conductor is broken, both LED 78 and 80 will be turned OFF.

D. Alternative Voltage Supplies

Figure 4:
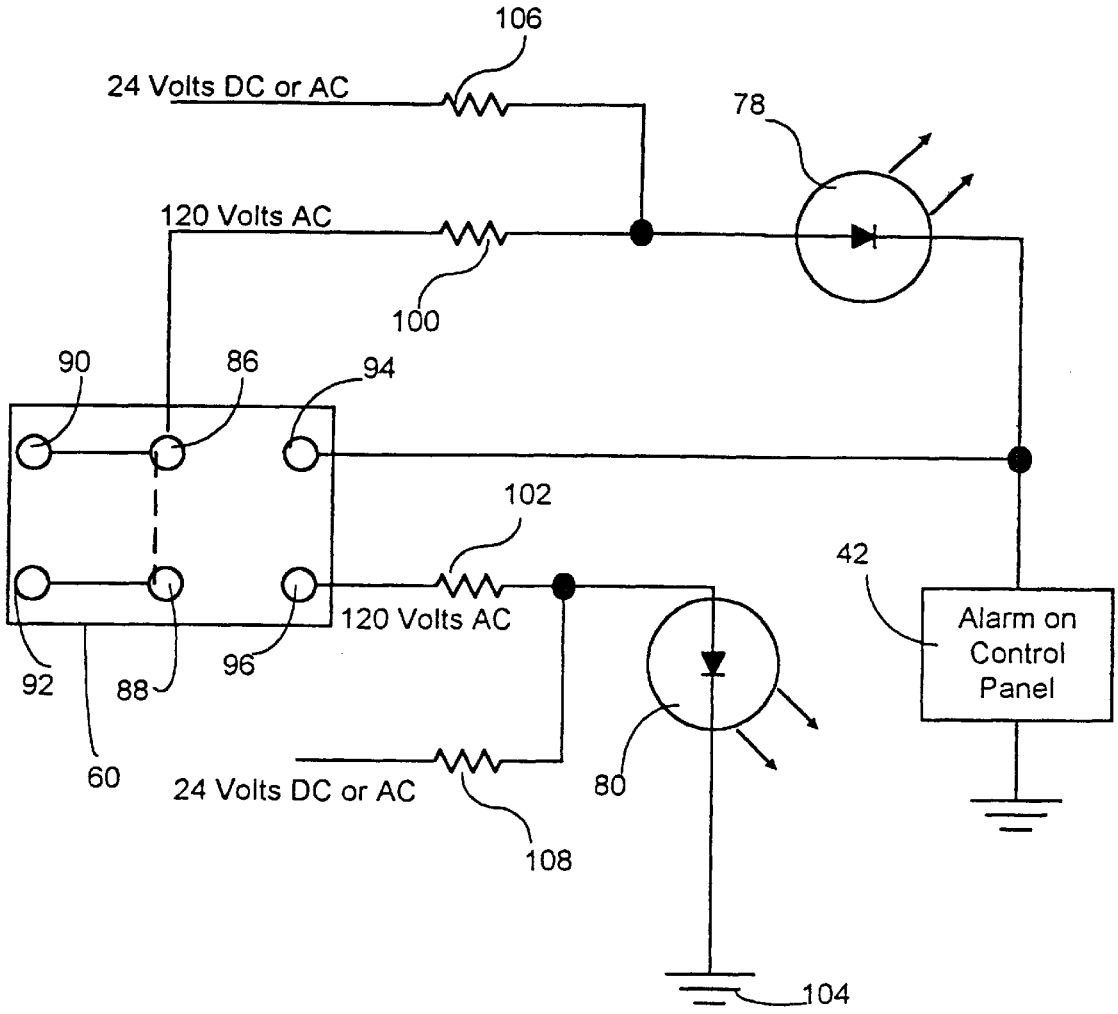
FIG. 4 is a schematic diagram of the electrical circuitry for controlling the alarm of FIG. 2 wherein the circuitry is adapted for using multiple power supplies, including a 120-volt AC source and a 24-volt AC or DC source.

FIG. 4 shows an electrical schematic diagram of the circuit of FIG. 3 adapted to receive either 24 volts AC or DC or 120 volts AC. The switch 60 is shown in its non-alarm state, having terminals 86 and 90 coupled together and terminals 88 and 92 coupled together. The operation of the circuit is similar to that described in FIG. 3.

However, FIG. 4 illustrates that an additional set of resistors, 106, 108 are used to connect a 24-volt AC or DC supply when desired. To use the 24-volt supply, the resistor 100 that is operably coupled to terminal 86 is disconnected, and the resistor 106 is connected to terminal 86 in its place. Similarly, the resistor 102 is disconnected from terminal 96, and resistor 108 is connected to terminal 96 in its place. The resistors 100 and 102 are capped for safety reasons and are left unconnected. Preferably, the resistor values of resistors 106 and 108 are 3.5 kilohms one-quarter-watt resistors.

E. Alternative Embodiments

Having illustrated and described the principles of our invention with reference to preferred embodiments thereof, it should be apparent to those skilled in the art that the embodiment can be modified in arrangement and detail without departing from such principles.

For example, although the voltage sources shown are 120-volt and 24-volt sources, other sources can be used. The resistor values should be adjusted accordingly to maintain the current at approximately 10 milliamps.

Additionally, although LEDs 78 and 80 are shown primarily as the indicator, other types of lights can be used, such as incandescent. Additionally, audible indicators may be used in place of the lights. For example, an audible indicator 110 is shown in FIG. 3 coupled at one end to terminal 96 of switch 60, and at an opposed end to ground 112. The audible indicator 110 is shown in phantom to indicate that it need not be used at all. Alternatively, it may be used in place of LED 80 or in combination with LED 80. One skilled in the art will recognize that audible indicator 110 is activated in the same way indicator 80 is activated as described above.

Furthermore, although the alarm was shown for use in a fire-suppression system, the alarm may be used to indicate the state of sensors generally, wherever they may be used.

Still further, the alarm may be assembled by using a printed circuit board.

F. Dry-Contact Circuit

The foregoing disclosure has described applications of the invention primarily for use with existing fire-suppression-systems. The invention also can be employed in new fire-suppression system installations using a dry-contact circuit embodiment of the invention, which is described below. The dry-contact circuit allows the use of conventional pressure and flow sensors and conventional alarm monitoring circuitry.

Figure 5:
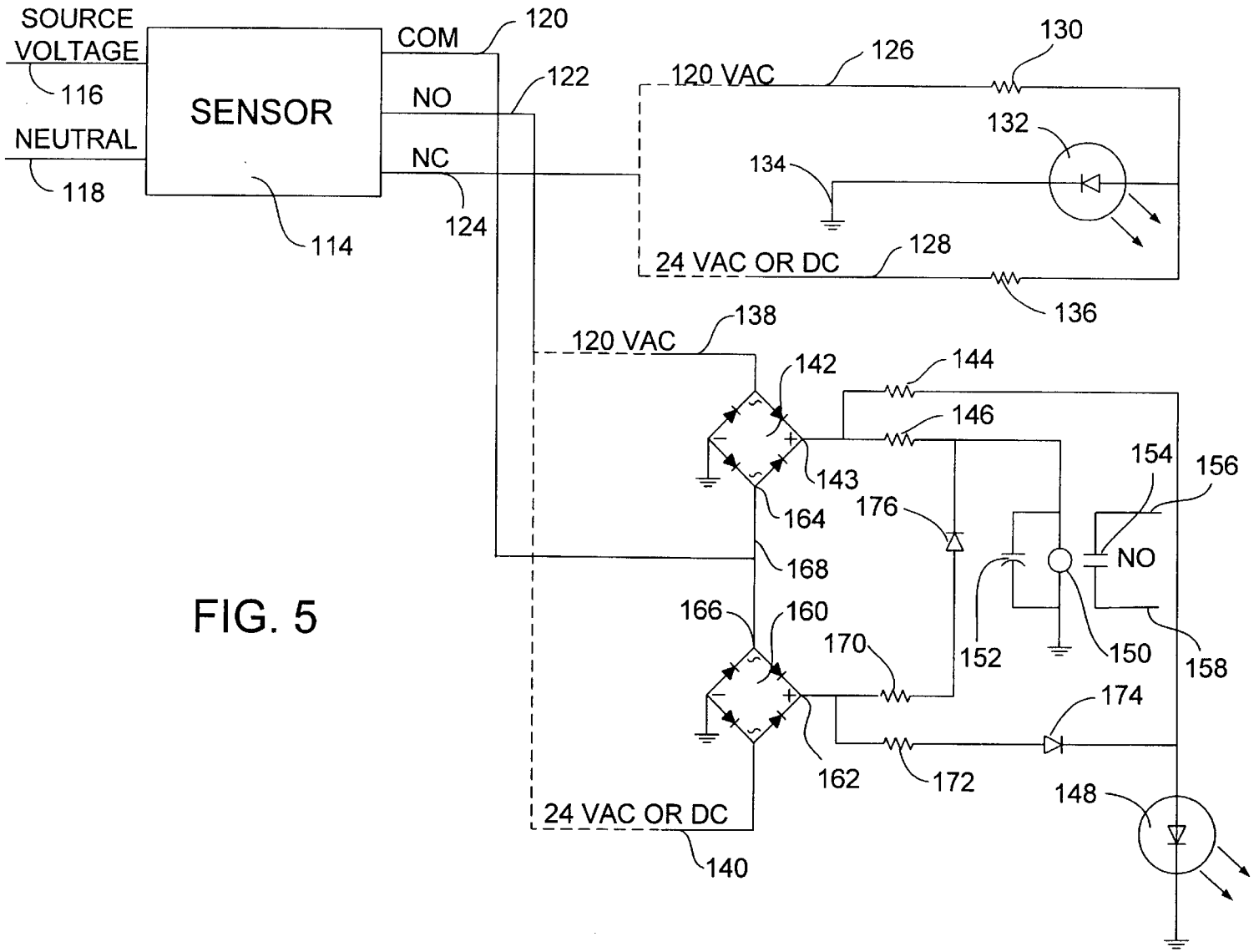
FIG. 5 is a schematic diagram of the electrical circuitry for a dry-contact embodiment of the present invention.

As shown in FIG. 5, the dry-contact circuit includes a sensor 114 that is connected to a source voltage 116 and a neutral line 118. The source voltage 116 can be either 120 VAC, 24 VAC or 24 VDC. The sensor 114 provides a common output 120, a normally-open (NO) output 122, and a normally-closed (NC) output 124. The voltage level at NO output 122 is left floating when the sensor 114 is in its normal non-activated condition, and is substantially equal to the source voltage 116 when the sensor 114 is activated. The voltage level at NC output 124 is the converse of the voltage at NO output 122—i.e., it is substantially equal to the source voltage 116 when the sensor 114 is in its non-activated condition, and is left floating when the sensor is activated.

The NC output 124, which is used to indicate that sensor 114 is powered, will be connected to either the 120 VAC Branch 126 or the 24 VAC or DC branch 128, corresponding to the source voltage 116. The 120 VAC branch 126 includes a current-limiting resistor 130 coupled at one end to the NC output 124, and at an opposing end to the anode of a power-indication LED 132. The cathode of the power-indication LED 132 is tied to ground 134. The 24 VAC or DC branch 128 is substantially similar to the 120 VAC Branch 130, except for the substitution of resistor 136 in place of resistor 130. Resistors 130 and 136 preferably are ½-watt resistors with a resistance selected to limit the current flowing through power-indication LED 132 to about 7 milliamps. For example, in a working embodiment resistor 130 was 3.3 kΩ and resistor 136 was 18 kΩ. LED 132 in a working embodiment was green in color, but can be any preselected color.

The NO output 122 is connected to either 120 VAC branch 138 or 24 VAC or DC branch 140, corresponding to the input voltage 116. The 120 VAC branch 138 is connected to a first full-wave rectifier bridge 142. The rectifier bridge 142 rectifies the 120 VAC input voltage to create a DC voltage at the positive bridge terminal 143, which is commonly connected to both first ends of resistors 144 and 146. The second end of resistor 144 is connected to the anode of an activation-indication LED 148, whose cathode is tied to ground. The second end of resistor 146 is connected to one side of coil 150, whose other side is tied to ground. A capacitor 152 is connected across the inputs of the coil 150. The coil 150 drives the normally-open (NO) contacts 154 so as to open and close a monitoring circuit (not shown), which is connected to the contacts 154 at points 156 and 158.

The resistor 144 was an 18 KΩ ½-watt resistor while the resistor 146 preferably was a 5 KΩ 1-watt resistor in a working embodiment. The coil 150 preferably is a 5-volt, 200 Ω coil, and the capacitor 152 preferably has a capacitance of 470 $\mu$f. The activation-indication LED 148 preferably is red in color.

The 24 VAC or DC branch 140 is connected to a second full-wave rectifier bridge 160. The rectifier bridge 160 rectifies the 24 VAC input voltage to create a DC voltage at the positive bridge terminal 162, or alternately produces a DC voltage at positive bridge terminal 162 if the input voltage is 24 volts DC. The rectifier bridges 142, 160 are commonly tied together at respective inputs 164, 166 by line 168, which in turn is tied to the common output 120 of sensor 114. The bridges 142, 160 preferably are rated for at least 1 amp. The positive bridge terminal 162 is commonly connected to one end of resistors 170 and 172. The other end of resistor 172 is connected to the anode of diode 174, the cathode of which is connected to the anode of the activation-indication LED 148. The other end of the resistor 170 is connected to the anode of diode 176, whose cathode is connected to the end of the resistor 146 that is tied to the coil 150.

Diodes 174, 176 in a working embodiment were IN 4001s or an equivalent thereto. The resistor 170 was an 1 KΩ ½-watt resistor, while the resistor 172 was a 3.3 KΩ ½-watt resistor.

The dry-contact circuit works as follows. When the sensor 114 is in its normal non-activated state, the voltage at NC output 124 is substantially equal to the source voltage 116, with this voltage driving the power-indication LED 132. Thus, under this condition the power-indication LED 132 is lighted, providing an indication that the sensor 114 is receiving power. The voltage at the NO output is left floating so that neither the coil 150 nor the activation-indication LED 148 is driven. As a result, the NO contacts 154 are left open, and the activation-indication LED 148 is not lighted. When the sensor 114 is activated, the voltage at NC output 124 is switched to floating, thereby removing the voltage from the anode of power-indication LED 132. At the same time, the voltage at the NO output 122 is switched to the source voltage, thereby driving the appropriate bridge 142 or 160 (depending on the source voltage 116) so as to produce a DC voltage that drives both the coil 150 and the activation-indication LED 148. The voltage across the coil 150 causes the NO contacts 154 to close, thereby causing the monitoring circuit, which is connected across leads 156, 158, to sense the activation of the sensor 114. The activation-indication LED 148 is also lighted under this condition.

In view of the many possible embodiments to which the principles or invention may be applied, it should be recognized that embodiments illustrated herein are only preferred examples of the invention and should not be taken as a limitation on the scope of the invention. Rather, the invention is defined by the following claims. We therefore claim as the invention all such embodiments that come within the scope of these claims.

What is claimed is:

1. An alarm for a fire-suppression system that includes a fluid-carrying conduit and at least one sensor mounted to the fluid-carrying conduit, the sensor having a first state indicating normal operation of the fire-suppression system and a second state indicating (1) a change in fluid flow or fluid pressure within the conduit or (2) movement of a valve controlling fluid flow to or through the conduit, the alarm comprising:

a first indicator mounted to the sensor, the first indicator being activated when the sensor is in the first state; and a second indicator mounted to the sensor, the second indicator being activated when the sensor is in the second state; and a sensor-signal output mechanism for informing a remote monitoring circuit when the sensor is in the second state, the sensor-signal output mechanism comprising a set of dry contacts that are open when the sensor is in the first state and are caused to close when the sensor is in the second state.

2. The alarm of claim 1, wherein the sensor provides a common, a normally-open, and a normally-closed output, the normally closed output energizing the first indicator when the sensor is in the first state, the normally-open output being closed and energizing the second indicator when the sensor is in the second state.

3. The alarm of claim 1 further comprising a control panel that is electrically coupled to the alarm by a conductor, the control panel remotely monitoring whether the sensor is in the first or second state.

4. A fire-suppression system, comprising:

a fluid-carrying conduit for supplying fire extinguishing fluid to a sprinkler system;

a sensor coupled to the fluid-carrying conduit, the sensor comprising a sensor element positioned within the fluid-carrying conduit for detecting changes in fluid rate or fluid pressure within the conduit, the sensor providing a first output that is activated when the sensor is in a first state indicating normal operation, the sensor providing a second output that is activated when the sensor is in a second state, the second state indicating sensor detection of changes in fluid flow rate or fluid pressure;

a first light-emitting diode mounted to and extending through the housing of the sensor and electrically coupled to the first output, the fist light-emitting diode being electrically activated when the sensor is in the first state and being electrically deactivated when the sensor is in the second state;

a second light-emitting diode mounted to and extending through the housing of the sensor and electrically coupled to the second output, the second light-emitting diode being electrically activated when the sensor is in the second state and being electrically deactivated when the sensor is in the first state;

a set of dry contacts electrically coupled to the second output, the contacts being open when the sensor is in the first state and caused to close when the sensor is in the second state; and a control panel electrically coupled to the contacts, the control panel activating an alarm condition when the sensor is in the second state.

5. The fire-suppression system of claim 4 further comprising a plurality of sensors mounted in the conduit.

6. The fire-suppression system of claim 5, wherein each of the sensors has a second-state output indicating the sensor has detected a change in fluid flow rate or fluid pressure, the second-state outputs being electrically coupled to the control panel.

* * * * *

UNITED STATES PATENT AND TRADEMARK OFFICE

CERTIFICATE OF CORRECTION

PATENT NO. : 6,195,002 B1
APPLICATION NO. : 09/245094
DATED : February 27, 2001
INVENTOR(S) : Evans, Jr. et al.

It is certified that error appears in the above-identified patent and that said Letters Patent is hereby corrected as shown below:

In the Claims

Col. 11, Line 24 replace “fist” with --first--.

Signed and Sealed this

Thirty-first Day of October, 2006

JON W. DUDAS
*Director of the United States Patent and Trademark Office*